US009013109B2

(12) United States Patent
Chiang et al.

(10) Patent No.: US 9,013,109 B2
(45) Date of Patent: Apr. 21, 2015

(54) LIGHT-EMITTING DIODE LIGHTING DEVICE WITH ADJUSTABLE CURRENT SETTINGS AND SWITCH VOLTAGES

(71) Applicant: IML International, Grand Cayman (KY)

(72) Inventors: Yung-Hsin Chiang, New Taipei (TW); Yi-Mei Li, New Taipei (TW); Woung Moo Lee, SungNam (KR); Hwan Lim, GoYang (KR)

(73) Assignee: IML International, Ugland House, Grand Cayman (KY)

( * ) Notice: Subject to any disclaimer, the term of this patent is extended or adjusted under 35 U.S.C. 154(b) by 0 days.

(21) Appl. No.: 14/149,838

(22) Filed: Jan. 8, 2014

(65) Prior Publication Data

US 2014/0217908 A1 Aug. 7, 2014

Related U.S. Application Data

(60) Provisional application No. 61/761,666, filed on Feb. 6, 2013.

(51) Int. Cl.
*H05B 33/08* (2006.01)
*H05B 37/02* (2006.01)

(52) U.S. Cl.
CPC ..... *H05B 33/083* (2013.01)

(58) Field of Classification Search
CPC ..... H05B 33/0806; H05B 37/02
USPC ..... 315/186, 185 R, 307; 363/126
See application file for complete search history.

(56) References Cited

U.S. PATENT DOCUMENTS

2012/0139448 A1* 6/2012 Chiang et al. ..... 315/307

* cited by examiner

*Primary Examiner* — Daniel D Chang
(74) *Attorney, Agent, or Firm* — Winston Hsu; Scott Margo

(57) ABSTRACT

An LED lighting device includes a first luminescent device, a second luminescent device, a first current controller and a second current controller. The first current controller is coupled in parallel with the first luminescent device and configured to operate according to a first current setting, a switch-on voltage and a switch-off voltage. The second current controller is coupled in series to the second luminescent device and configured to operate according to a second current setting. The first current setting, the second current setting, the switch-on voltage and the switch-off voltage are adjusted by setting the mode selection pins of the first and second current controllers.

15 Claims, 8 Drawing Sheets

LIGHT-EMITTING DIODE LIGHTING DEVICE WITH ADJUSTABLE CURRENT SETTINGS AND SWITCH VOLTAGES

CROSS REFERENCE TO RELATED APPLICATIONS

This application claims the benefit of U.S. provisional application No. 61/761,666 filed on Feb. 6, 2013.

BACKGROUND OF THE INVENTION

1. Field of the Invention

The present invention is related to an LED lighting device, and more particularly, to an LED lighting device with high power factor and adjustable characteristics.

2. Description of the Prior Art

Compared to traditional incandescent bulbs, light-emitting diodes (LEDs) are advantageous in low power consumption, long lifetime, small size, no warm-up time, fast reaction speed, and the ability to be manufactured as small or array devices. In addition to outdoor displays, traffic signs, and liquid crystal display (LCD) for various electronic devices such as mobile phones, notebook computers or personal digital assistants (PDAs), LEDs are also widely used as indoor/outdoor lighting devices in place of fluorescent of incandescent lamps.

An LED lighting device directly driven by a rectified alternative-current (AC) voltage usually adopts a plurality of LEDs coupled in series in order to provide required luminance. As the number of the LEDs increases, a higher forward-bias voltage is required for turning on the LED lighting device, thereby reducing the effective operational voltage range of the LED lighting device. As the number of the LEDs decreases, the large driving current when the rectified voltage is at its maximum level may impact the reliability of the LEDs. Therefore, there is a need for an LED lighting device capable of improving the effective operational voltage range and the reliability.

SUMMARY OF THE INVENTION

The present invention provides an LED lighting device including a first luminescent device, a second luminescent device, a first current controller and a second current controller. The first luminescent device includes a first end coupled to a rectified AC voltage and a second end. The second luminescent device is coupled in series to the first luminescent device. The first current controller is configured to operate according to a first current setting and a first switch voltage, and includes a first pin coupled to the first end of the first luminescent device; a second pin coupled to the second end of the first luminescent device; and a plurality of mode selection pins arranged to set the first current setting and/or the first switch voltage. The second current controller is configured to operate according to a second current setting and includes a first pin coupled to the second luminescent device; a second pin coupled to the rectified AC voltage; and a plurality of mode selection pins arranged to set the second current setting.

The present invention also provides an LED lighting device including first to fourth luminescent devices and first to fourth current controllers. The first luminescent device includes a first end coupled to a rectified AC voltage and a second end. The second luminescent device includes a first end coupled to the second end of the first luminescent device and a second end. The third luminescent device includes a first end coupled to the second end of the second luminescent device and a second end. The fourth luminescent device includes a first end coupled to the second end of the third luminescent device and a second end. The first current controller is configured to conduct first current smaller than or equal to a first current setting, switch off according a first switch-off voltage during a rising period of the rectified AC voltage, and switch on according a first switch-on voltage during a falling period of the rectified AC voltage. The first current controller includes a first pin coupled to the first end of the first luminescent device; a second pin coupled to the second end of the first luminescent device; and a first mode selection pin and a second mode selection pin for setting the first current setting, the first switch-on voltage, and/or the first switch-off voltage. The second current controller is configured to conduct second current smaller than or equal to a second current setting, switch off according a second switch-off voltage during the rising period, and switch on according a second switch-on voltage during the falling period. The second current controller includes a first pin coupled to the first end of the second luminescent device; a second pin coupled to the second end of the second luminescent device; and a first mode selection pin and a second mode selection pin for setting the second current setting, the second switch-on voltage, and/or the second switch-off voltage. The third current controller is configured to conduct third current smaller than or equal to a third current setting, switch off according a third switch-off voltage during the rising period, and switch on according a third switch-on voltage during the falling period. The third current controller includes a first pin coupled to the first end of the third luminescent device; a second pin coupled to the second end of the third luminescent device; and a first mode selection pin and a second mode selection pin for setting the third current setting, the third switch-on voltage, and/or the third switch-off voltage. The fourth current controller is configured to conduct fourth current smaller than or equal to a fourth current setting and includes a first pin coupled to the second end of the fourth luminescent device; a second pin coupled to the rectified AC voltage; and a first mode selection pin and a second mode selection pin for setting the fourth current setting. The fourth current setting is larger than any of the first to third current settings.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
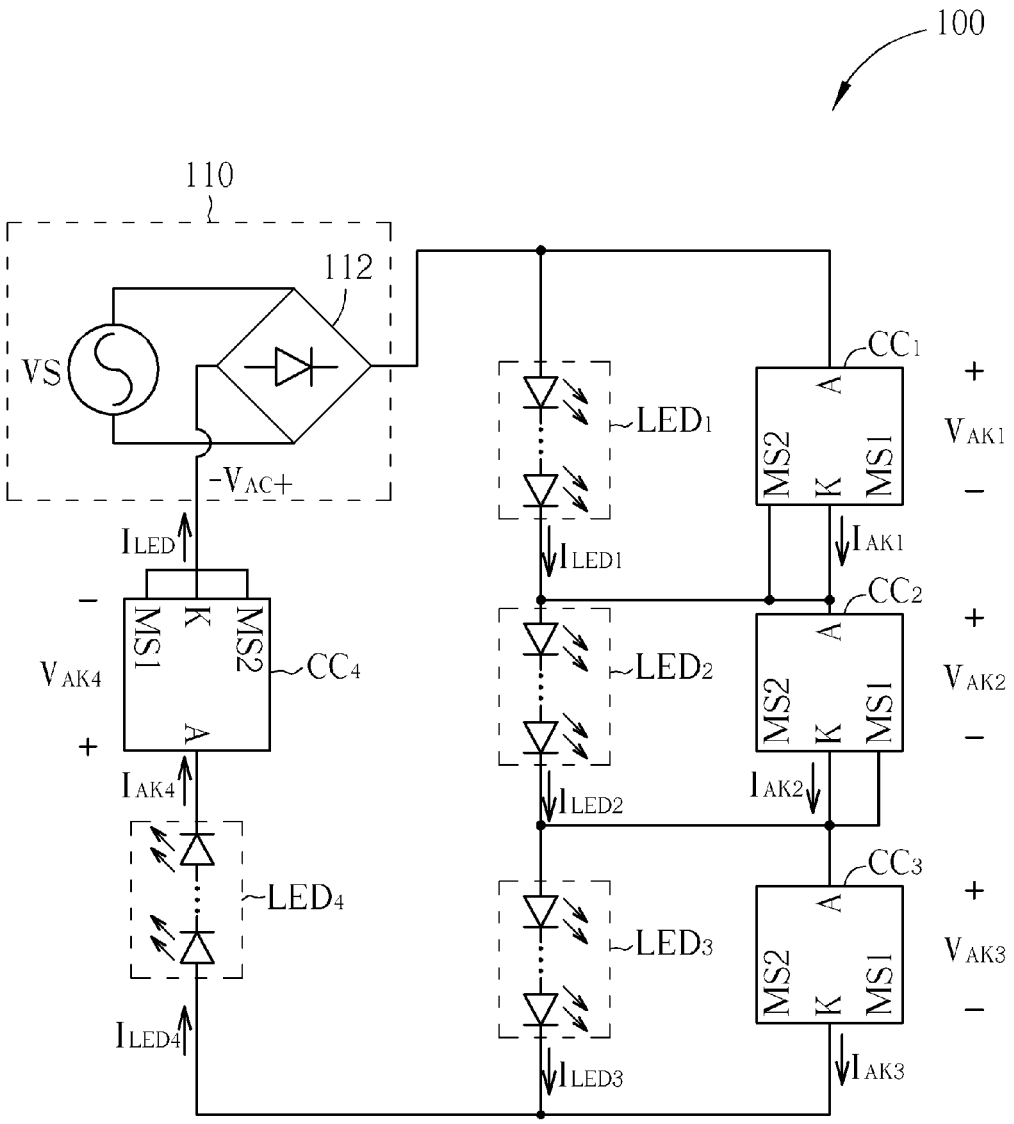
FIG. 1 is a diagram of an LED lighting device according to an embodiment of the present invention.

FIG. 1 is a diagram of an LED lighting device 100 according to an embodiment of the present invention. The LED lighting device 100 includes a power supply circuit 110, (N+1) current controllers $CC_1$~$CC_{N+1}$, and (N+1) luminescent devices $LED_1$~$LED_{N+1}$ (N is a positive integer). The power supply circuit 110 is configured to receive an AC voltage VS having positive and negative periods and convert the output of the AC voltage VS in the negative period using a bridge rectifier 112, thereby providing a rectified AC voltage $V_{AC}$, whose value varies periodically with time, for driving the (N+1) luminescent devices $LED_1$~$LED_{N+1}$. In another embodiment, the power supply circuit 110 may receive any AC voltage VS, perform voltage conversion using an AC-AC converter, and rectify the converted AC voltage VS using the bridge rectifier 112, thereby providing the rectified AC voltage $V_{AC}$ whose value varies periodically with time. The configuration of the power supply circuit 110 does not limit the scope of the present invention.

Each of the luminescent devices $LED_1$~$LED_{N+1}$ may include a single light-emitting diode or multiple light-emitting diodes coupled in series. FIG. 1 depicts the embodiment using multiple light-emitting diodes, but does not limit the scope of the present invention.

Each of the current controllers $CC_1$~$CC_N$ is coupled in parallel with each of the corresponding luminescent devices $LED_1$~$LED_N$, respectively. The current controller $CC_{N+1}$ is coupled in series to the luminescent device $LED_{N+1}$. Each of the current controllers $CC_1$~$CC_{N+1}$ may be fabricated as a chip having a first pin A, a second pin K and n mode selection pins MS1~MSn, wherein n is a positive integer satisfying $2^n \geq (N+1)$. In the current controllers $CC_1$~$CC_N$, Pin A and Pin K of each current controller are coupled to the two ends of a corresponding luminescent device among the luminescent devices $LED_1$~$LED_N$, while mode selection pins MS1~MSn are either coupled to its Pin A, Pin K or floating. In the current controller $CC_{N+1}$, Pin A is coupled to the luminescent devices $LED_{N+1}$, Pin K is coupled to the power supply circuit 110, while, mode selection pins MS1~MSn are either coupled to its Pin A, Pin K or floating.

For ease of illustration, FIG. 1 depicts the embodiment when N=3 and n=2. $V_{AK1}$~$V_{AK4}$ represent the voltages established across the corresponding current controllers $CC_1$~$CC_4$, respectively. $I_{AK1}$~$I_{AK4}$ represent the current flowing through the corresponding current controllers $CC_1$~$CC_4$, respectively. $I_{LED1}$~$I_{LED4}$ represent the current flowing through the corresponding luminescent devices $LED_1$~$LED_4$, respectively. $I_{LED}$ represents the overall current of the LED lighting device 100.

Figure 6:
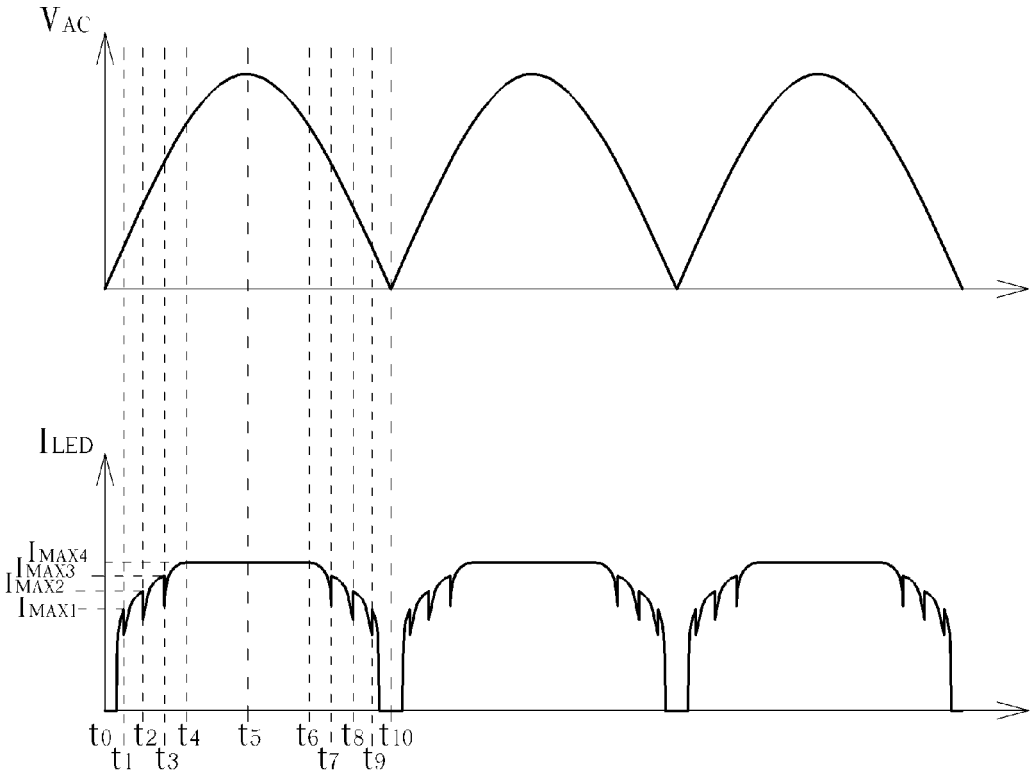

FIGS. 2~6 illustrate the operation of the LED lighting device 100, wherein FIGS. 2~5 are diagrams illustrating the current-voltage (I-V) curves of the current controllers $CC_1$~$CC_4$, and FIG. 6 is a diagram illustrating the variations in the related current and voltage when operating the LED lighting device 100. $V_{C1}$~$V_{C4}$ represent the cut-in voltages at which the current controllers $CC_1$~$CC_4$ begin to conduct, respectively. $V_{DROP1}$~$V_{DROP4}$ represent the drop-out voltages of the current controllers $CC_1$~$CC_4$ at which the current $I_{AK1}$~$I_{AK4}$ reach corresponding current settings $I_{MAX1}$~$I_{MAX4}$, respectively. $V_{ON1}$~$V_{ON3}$ represent the switch-on voltages of the current controllers $CC_1$~$CC_3$, respectively. $V_{OFF1}$~$V_{OFF3}$ represent the switch-off voltages of the current controllers $CC_1$~$CC_3$, respectively. In the embodiment of the present invention, the cut-in voltages $V_{C1}$~$V_{C4}$ of the current controllers $CC_1$~$CC_4$ are smaller than the cut-in voltages of the corresponding luminescent devices $LED_1$~$LED_4$.

In FIGS. 2~5, during the rising and falling periods of the rectified voltage $V_{AC}$ when $0<V_{AK1}<V_{DROP1}$, $0<V_{AK2}<V_{DROP2}$, $0<V_{AK3}<V_{DROP3}$, or $0<V_{AK4}<V_{DROP4}$, each of the current controllers $CC_1$~$CC_4$ is not completely turned on and operates as a voltage-controlled device in a linear mode in which the current $I_{AK1}$~$I_{AK4}$ changes with the voltages $V_{AK1}$~$V_{AK4}$ in a specific manner, respectively. For example, if the current controller $CC_1$ is implemented using metal-oxide-semiconductor (MOS) transistors, the relationship between the current $I_{AK1}$ and the voltage $V_{AK1}$ may correspond to the I-V characteristic of an MOS transistor when operating in the linear region.

In FIGS. 2~5, during the rising period of the rectified voltage $V_{AC}$ when $V_{DROP1}<V_{AK1}<V_{OFF1}$, $V_{DROP2}<V_{AK2}<V_{OFF2}$, $V_{DROP3}<V_{AK3}<V_{OFF3}$, or $V_{DROP4}<V_{AK4}$, and during the falling period of the rectified voltage $V_{AC}$ when $V_{DROP1}<V_{AK1}<V_{ON1}$, $V_{DROP2}<V_{AK2}<V_{ON2}$, $V_{DROP3}<V_{AK3}<V_{ON3}$, or $V_{DROP4}<V_{AK4}$, each of the current controllers $CC_1$~$CC_4$ operates in a constant-current mode and functions as a current limiter. Therefore, the current $I_{AK1}$~$I_{AK4}$ flowing through the current controllers $CC_1$~$CC_4$ may be clamped at the constant values $I_{MAX1}$~$I_{MAX4}$, respectively, instead of changing with the voltages $V_{AK1}$~$V_{AK4}$.

Figure 2:
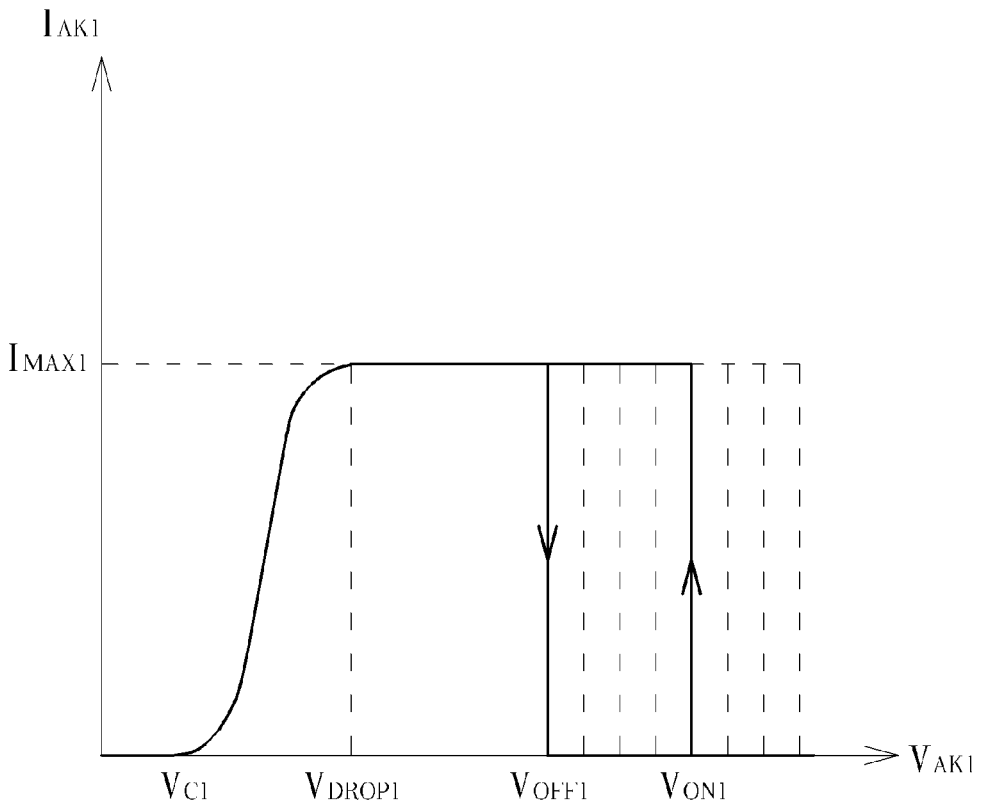
FIGS. 2~6 are diagrams illustrating the operation of the LED lighting device of the present invention.
Figure 3:
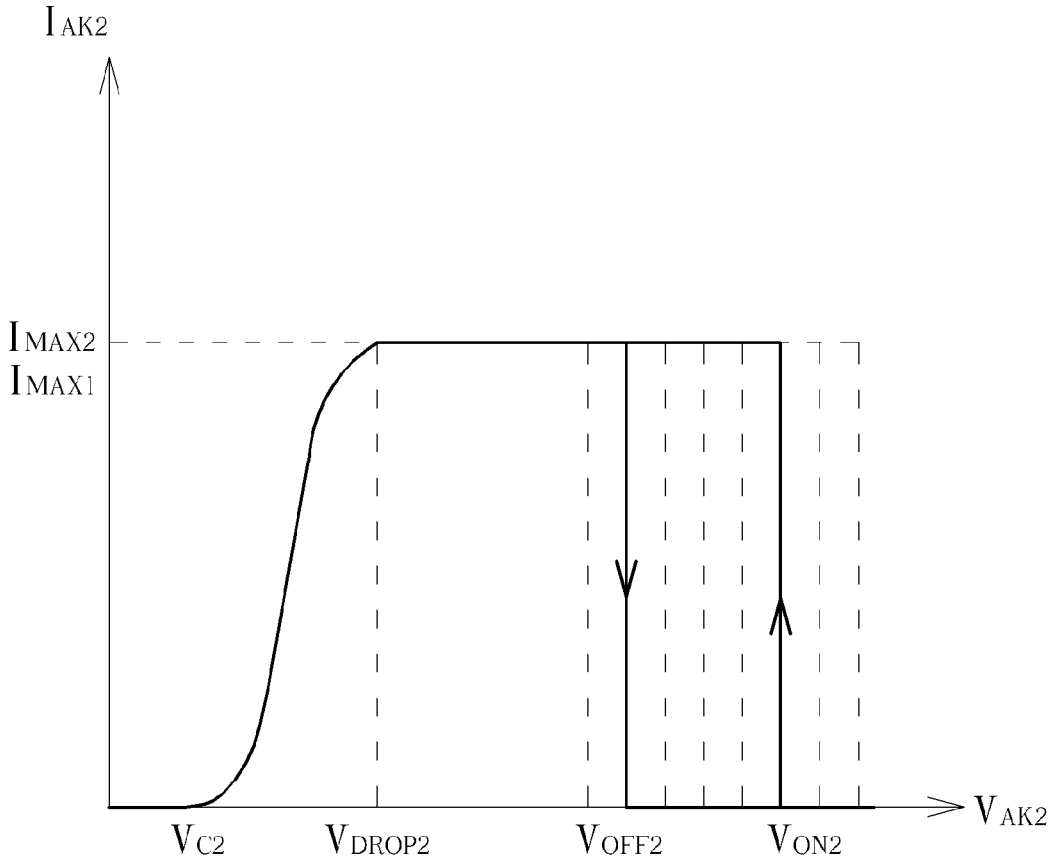
Figure 4:
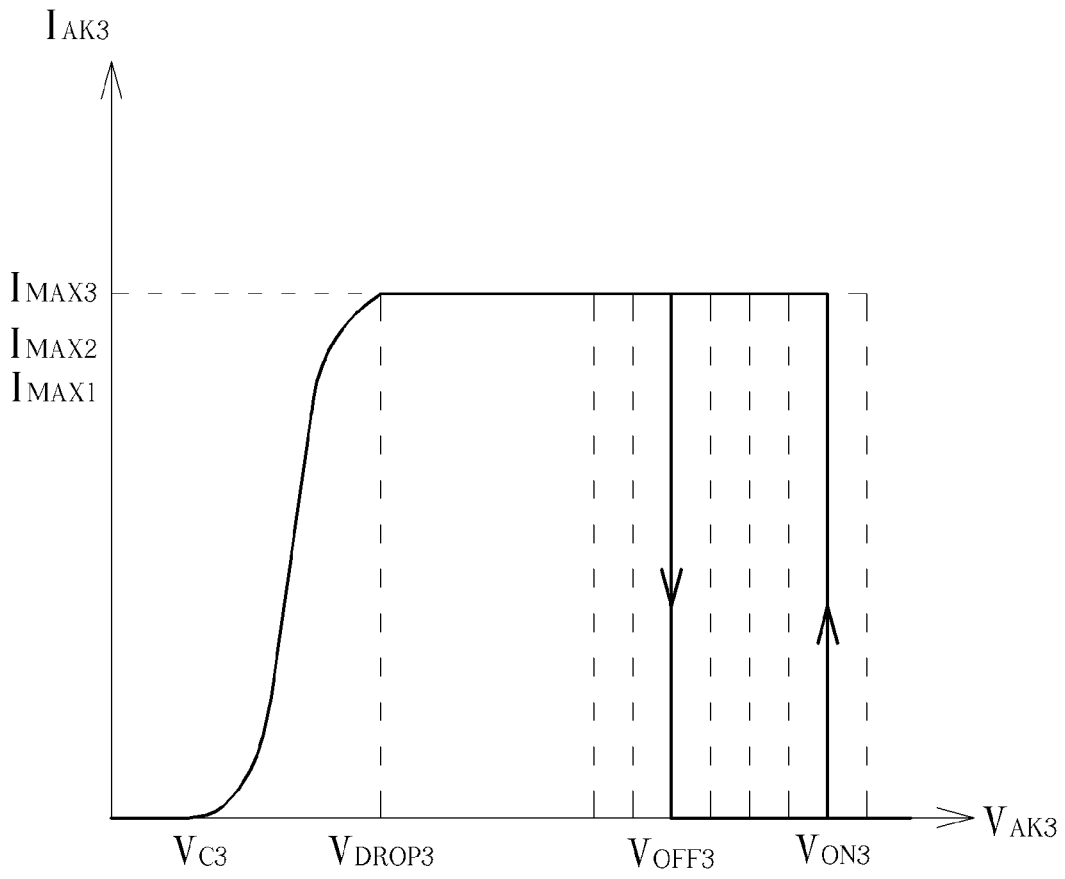
Figure 5:
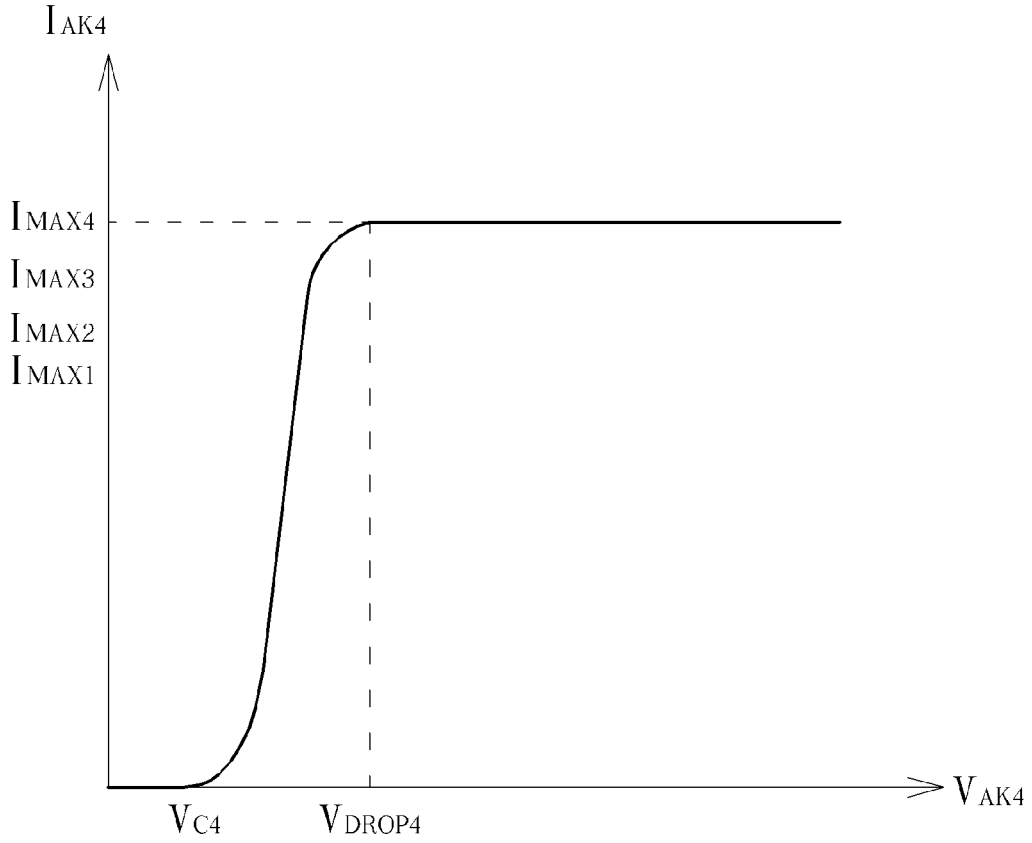

In FIGS. 2~4, during the rising period of the rectified voltage $V_{AC}$ when the voltages $V_{AK1}$~$V_{AK3}$ exceed the corresponding switch-off voltages $V_{OFF1}$~$V_{OFF3}$, the current $I_{AK1}$~$I_{AK3}$ drops to zero and the current controllers $CC_1$~$CC_3$ switch to a cut-off mode. In other words, each of the current controllers $CC_1$~$CC_3$ functions as an open-circuited device, allowing the current $I_{LED1}$~$I_{LED3}$ to increase with the rectified voltage $V_{AC}$, or clamped by an adjacent current controller which operates in the constant-current mode. During the falling period of the rectified voltage $V_{AC}$ when the voltages $V_{AK1}$~$V_{AK3}$ drop below the corresponding switch-on voltages $V_{ON1}$~$V_{ON3}$, each of the current controllers $CC_1$~$CC_3$ switches to the constant-current mode and functions as a current limiter.

FIG. 6 illustrates the waveforms of the voltage $V_{AC}$ and the current $I_{LED}$ when operating the LED lighting device 100. Since the value of the rectified AC voltage $V_{AC}$ varies periodically with time, a cycle between $t_0$-$t_{10}$ is used for illustration, wherein the period between $t_0$-$t_5$ belongs to the rising period of the rectified AC voltage $V_{AC}$ and the period between $t_5$-$t_{10}$ belongs to the falling period of the rectified AC voltage $V_{AC}$.

The operation of the LED lighting device 100 during the rising period is hereby explained. Between $t_0$-$t_1$ when the voltages $V_{AK1}$~$V_{AK4}$ increase with the rectified AC voltage $V_{AC}$, the current controllers $CC_1$~$CC_4$ are turned on earlier due to smaller cut-in voltages, and the current $I_{LED}$ sequentially flows through the current controllers $CC_1$~$CC_3$, the luminescent device $LED_4$, and the current controller $CC_4$. Between $t_1$~$t_2$ when the voltage $V_{AK1}$ is larger than the switch-off voltage $V_{OFF1}$, the current controller $CC_1$ is turned off first, and the current $I_{LED}$ sequentially flows through the luminescent device $LED_1$, the current controllers $CC_2$~$CC_3$, the luminescent device $LED_4$, and the current controller $CC_4$. Between $t_2$~$t_3$ when the voltage $V_{AK2}$ is larger than the switch-off voltage $V_{OFF2}$, the current controller $CC_2$ is turned off next, and the current $I_{LED}$ sequentially flows through the luminescent devices $LED_1$~$LED_2$, the current controller $CC_3$, the luminescent device $LED_4$, and the current controller $CC_4$. Between $t_3$~$t_4$ when the voltage $V_{AK3}$ is larger than the switch off voltage $V_{OFF3}$, the current controller $CC_3$ is turned off next, and the current $I_{LED}$ sequentially flows through the luminescent devices $LED_1$~$LED_4$ and the current controller $CC_4$. Between $t_4$~$t_5$, the current $I_{LED}$ is clamped at the constant value $I_{MAX4}$ by the current controller $CC_4$.

During the falling period $t_5$~$t_{10}$ when the voltages $V_{AK3}$, $V_{AK2}$ and $V_{AK1}$ sequentially drop below the switch-on voltages $V_{ON3}$, $V_{ON2}$ and $V_{ON1}$, respectively, the current controllers $CC_3$~$CC_1$ are sequentially turned on at $t_7$-$t_{10}$, respectively. The intervals $t_0$~$t_1$, $t_1$~$t_2$, $t_2$~$t_3$, $t_3$~$t_4$ and $t_4$~$t_5$ during the rising period correspond to the intervals $t_9$~$t_{10}$, $t_8$~$t_9$, $t_7$~$t_8$, $t_6$~$t_7$ and $t_5$~$t_6$ during the falling period, Therefore, the operation of the LED lighting device 100 during $t_5$-$t_{10}$ is similar to that during $t_0$~$t_5$, as detailed in previous paragraphs.

In many applications, the luminescent devices $LED_1$~$LED_4$ may be required to provide different luminescence or become luminescent at different time. The present invention may thus provide flexible designs using the current controllers $CC_1$~$CC_4$ with flexible current settings and switch-on/off voltages by setting the mode selection pins MS1 and MS2. Therefore, the turn-on/off sequence, turn-on/off period and the brightness of each luminescent device may be easily selected. In the embodiment depicted in FIGS. 2~6 for illustrative purpose, the current controllers $CC_1$~$CC_4$ are configured in a way so that $I_{MAX1}<I_{MAX2}<I_{MAX3}<I_{MAX4}$, $V_{ON1}<V_{ON2}<V_{ON3}$, and $V_{OFF1}<V_{OFF2}<V_{OFF3}$. In other words, during the same period, the luminescent device $LED_4$ has the longest conducting time and the luminescent device $LED_1$ has the shortest conducting time.

Figure 7:
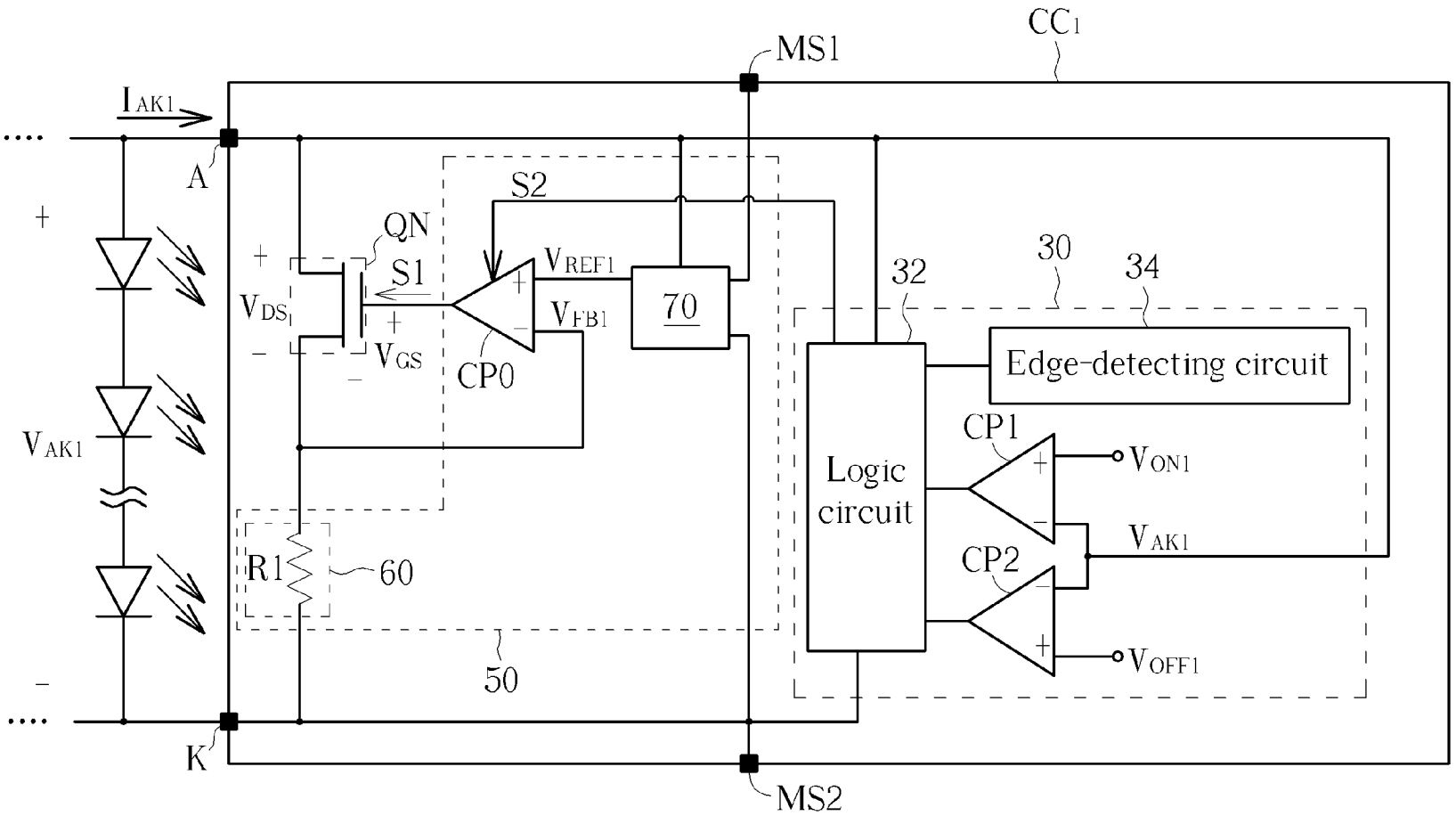
FIG. 7 is a diagram of the current controller according to an embodiment of the present invention.

FIG. 7 is a diagram of the current controllers $CC_1$~$CC_{N+1}$ according to an embodiment of the present invention. The current controller $CC_1$ is depicted herein for illustrative purpose, and includes a switch QN, a voltage-detecting circuit 30, and a control circuit 50.

The switch QN may include a field effect transistor (FET), a bipolar junction transistor (BJT) or other devices having similar function. In FIG. 7, an N-type metal-oxide-semiconductor (NMOS) transistor is used for illustration, but does not limit the scope of the present invention. With the gate coupled to the control circuit 50 for receiving a control signal S1, the drain-to-source voltage, the gate-to-source voltage and the threshold voltage of the switch QN are represented by $V_{DS}$, $V_{GS}$ and $V_{TH}$, respectively. When the switch QN operates in the linear region, its drain current is mainly determined by the drain-to-source voltage $V_{DS}$; when the switch QN operates in the saturation region, its drain current is only related to the gate-to-source voltage $V_{GS}$.

During the rising period of the rectified AC voltage $V_{AC}$, the drain-to-source voltage $V_{DS}$ of the switch QN increases with the voltage $V_{AK1}$ When the voltage $V_{AK1}$ does not exceed $V_{DROP1}$, the drain-to-source voltage $V_{DS}$ is smaller than the difference between the gate-to-source voltage $V_{GS}$ and the threshold voltage $V_{TH}$ ($V_{DS}<V_{GS}-V_{TH}$). The control signal S1 from the control circuit 50 provides a bias condition $V_{GS}>V_{TH}$ which allows the switch QN to operate in the linear region where the drain current is mainly determined by the drain-to-source voltage $V_{DS}$. In other words, the current controller $CC_1$ is configured to provide the current $I_{AK1}$ and the voltage $V_{AK1}$ whose relationship corresponds to the I-V characteristic of the switch QN when operating in the linear region.

During the rising period of the rectified AC voltage $V_{AC}$ when the voltage $V_{AK1}$ falls between $V_{DROP1}$ and $V_{OFF1}$, the drain-to-source voltage $V_{DS}$ is larger than the difference between the gate-to-source voltage $V_{GS}$ and the threshold voltage $V_{TH}$ ($V_{DS}>V_{GS}-V_{TH}$). The control signal S1 from the control circuit 50 provides a bias condition $V_{GS}>V_{TH}$ which allows the switch QN to operate in the saturation region where the drain current is only related to the gate-to-source voltage $V_{GS}$ and the current $I_{AK1}$ no longer varies with the voltage $V_{AK1}$.

The voltage-detecting circuit 30 includes a logic circuit 32, an edge-detecting circuit 34, and two hysteresis comparators CP1 and CP2. The hysteresis comparator CP1 is configured to determine the relationship between the voltages $V_{AK1}$ and $V_{ON1}$, while the hysteresis comparator CP2 is configured to determine the relationship between the voltages $V_{AK1}$ and $V_{OFF1}$. Meanwhile, when the voltages $V_{AK1}$ is between $V_{OFF1}$ and $V_{ON1}$, the voltage edge-detecting circuit 34 is configured to determine whether the rectified AC voltage $V_{AC}$ is during the rising period or during the falling period. Based on the results of the edge-detecting circuit 34 and the hysteresis comparators CP1 and CP2, the logic circuit 32 outputs a corresponding control signal S2 to the control circuit 50.

The control circuit 50 includes a comparator CP0, a current-detecting circuit 60, and an adjustable reference voltage generator 70. The current-detecting circuit 60 is configured to detect the current $I_{AK1}$ flowing through the switch QN for determining whether the corresponding voltage $V_{AK1}$ exceeds $V_{DROP1}$. In the embodiment depicted in FIG. 7, the current-detecting circuit 60 includes a resistor R1 for providing a feedback voltage $V_{FB1}$ which is associated with the current $I_{AK1}$ passing the switch QN. The configuration of the current-detecting circuit 60 does not limit the scope of the present invention.

The adjustable reference voltage generator 70 is configured to provide multiple reference voltages $V_{REF1}$~$V_{REF4}$ associated with the voltage $V_{AK1}$~$V_{AK4}$ and output one of the $V_{REF1}$~$V_{REF4}$ according the logic levels of two mode selection pins MS1 and MS2. For example, the adjustable reference voltage generator 70 provides the reference voltage $V_{REF1}$ to the comparator CP0 in the current controller $CC_1$ depicted in FIG. 7. Similarly, the reference voltages $V_{REF2}$~$V_{REF4}$ may be provided in the corresponding current controllers $CC_2$~$CC_4$, respectively.

The comparator CP0 is configured to output the control signal S1 for operating the switch QN according to the control signal S2, the feedback voltage $V_{FB1}$ and the reference voltage $V_{REF1}$ When $V_{FB1}<V_{REF1}$, the comparator CP0 raises the control signal S1 for increasing the current flowing through the switch QN until the feedback voltage $V_{FB1}$ reaches the reference voltage $V_{REF1}$. When $V_{FB1}>V_{REF1}$, the comparator CP0 lowers the control signal S1 for reducing the current flowing through the switch QN until the feedback voltage $V_{FB1}$ reaches the reference voltage $V_{REF1}$.

The maximum current setting $I_{MAX1}$ of the current controller $CC_1$ may be determined by the ($V_{REF1}$/R1). The maximum current setting $I_{MAX2}$ of the current controller $CC_2$ may be determined by the ($V_{REF2}$/R2). The maximum current setting $I_{MAX3}$ of the current controller $CC_3$ may be determined by the ($V_{REF3}$/R3). The maximum current setting $I_{MAX4}$ of the current controller $CC_4$ may be determined by the ($V_{REF4}$/R4). By setting the logic levels of the mode selection pins MS1 and MS2 of each current controller, the current controllers $CC_1$~$CC_4$ may provide different current settings and switch-on/off voltages, as depicted in FIGS. 2-5.

In an embodiment of the present invention, the LED lighting device 100 may also provide over-voltage protection. More specifically, the current controller $CC_4$ may further be configured to switch off when the voltage established across its Pin A and Pin K exceeds a predetermined value.

Figure 8:
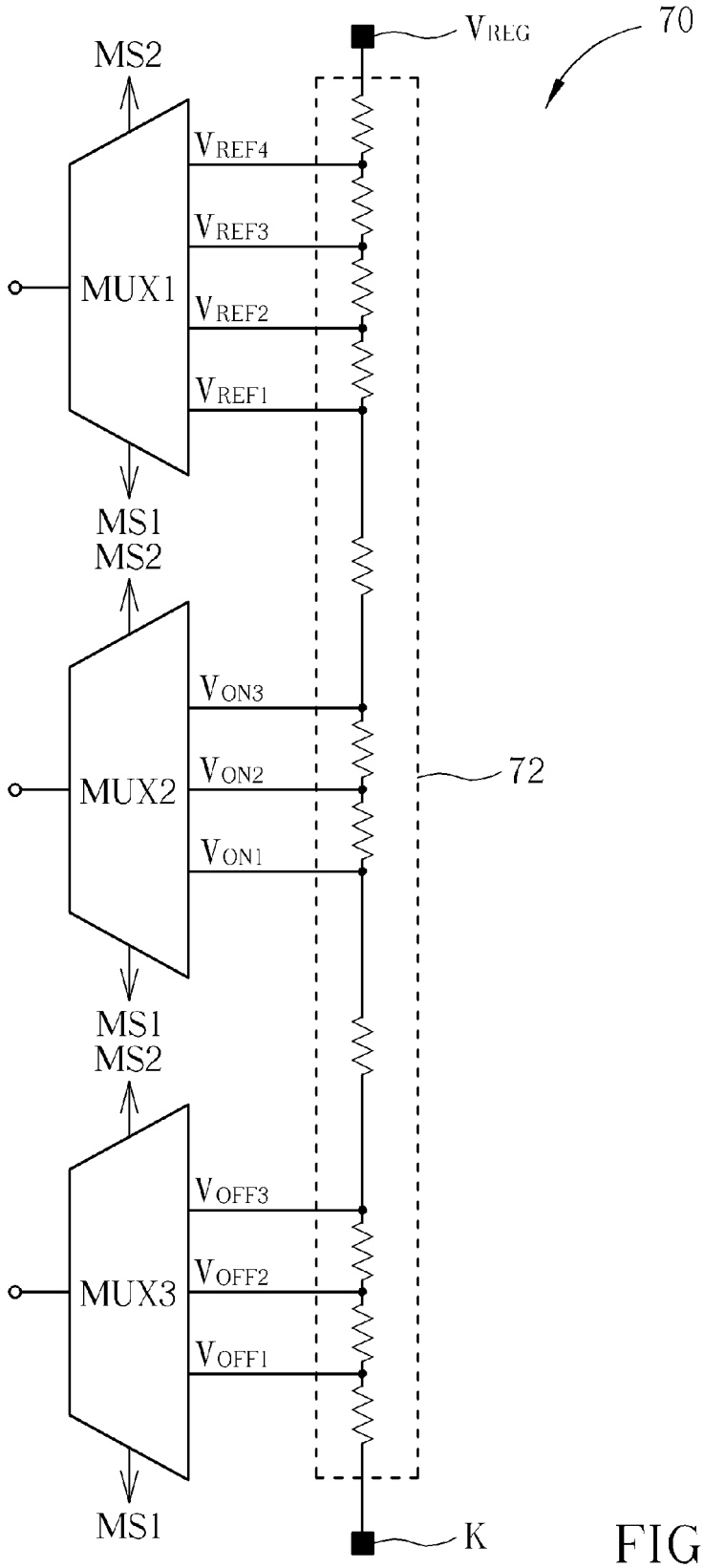
FIG. 8 is a diagram of the adjustable reference voltage generator according to an embodiment of the present invention.

FIG. 8 is a diagram illustrating an embodiment of the adjustable reference voltage generator 70. The adjustable reference voltage generator 70 includes a voltage-dividing circuit 72 and selection units MUX1~MUX3. The voltage-dividing circuit 72 may include a resistor string for providing a plurality of voltages $V_{REF1}$~$V_{REF4}$, $V_{ON1}$~$V_{ON3}$ and $V_{OFF1}$~$V_{OFF3}$ from an internal supply voltage $V_{REG}$. The internal supply voltage $V_{REG}$ may be provided by an internal voltage source of the chip, such as a low dropout (LDO) regulator. The selection unit MUX1 is configured to output one of the voltages $V_{REF1}$-$V_{REF4}$ as the reference voltage according to the logic levels of the mode selection pins MS1 and MS2. The selection unit MUX2 is configured to output one of the voltages $V_{ON1}$~$V_{ON3}$ as the switch-on voltage according to the logic levels of the mode selection pins MS1 and MS2. The selection unit MUX3 is configured to output one of the voltages $V_{OFF1}$-$V_{OFF3}$ as the switch-off voltage according to the logic levels of the mode selection pins MS1 and MS2. The following table is the example of the current/voltage settings of the current controllers $CC_1$~$CC_4$ according to the embodiment of FIG. 1, but does not limit the scope of the present invention.

| Current Controller | Mode Selection Pin MS2 | Mode Selection Pin MS1 | Reference Voltage | Switch-on/off Voltage value | Switch-on/off Voltage ratio | Current Setting value | Current Setting ratio |
|---|---|---|---|---|---|---|---|
| $CC_1$ | 0 | 1 | $V_{REF1}$ | $V_{ON1}$ $V_{OFF1}$ | 89% | $I_{MAX1}$ | 33% |
| $CC_2$ | 1 | 0 | $V_{REF2}$ | $V_{ON2}$ $V_{OFF2}$ | 95% | $I_{MAX2}$ | 55% |
| $CC_3$ | 1 | 1 | $V_{REF3}$ | $V_{ON3}$ $V_{OFF3}$ | 100% | $I_{MAX3}$ | 80% |
| $CC_4$ | 0 | 0 | $V_{REF4}$ | | | $I_{MAX4}$ | 100% |

In the embodiment illustrated above, the current controller $CC_4$ may be configured to provide the largest current setting $I_{MAX4}$, while the current controller $CC_1$ may be configured to provide the smallest current setting $I_{MAX1}$ ($I_{MAX1}$=0.33*$I_{MAX4}$). The current controller $CC_3$ may be configured to provide the largest switch-on/off voltage $V_{ON3}$/$V_{OFF3}$, while the current controller $CC_1$ may be configured to provide the smallest switch-on/off voltage $V_{ON1}$/$V_{OFF1}$ ($V_{ON1}$=0.89*$V_{ON3}$ and $V_{OFF1}$=0.89*$V_{OFF3}$).

In the present invention, a corresponding pair of the current controller and the luminescent device may be fabricated as an integrated chip, such as an integrated chip U1 containing the current controller $CC_1$ and the luminescent device $LED_1$, an integrated chip U2 containing the current controller $CC_2$ and the luminescent device $LED_2$, . . . , and an integrated chip UN containing the current controller $CC_N$ and the luminescent device $LED_N$. The integrated chips U1~UN as stand-alone devices may be fabricated in the same manufacturing process. According to different applications, various LED lighting devices may be fabricated using multiple integrated chips U1~UN with selected printed circuit board (PCB) layouts for setting the logic levels of the mode selection pins. Therefore, the present invention may provide LED lighting devices with various characteristics without complicating manufacturing process.

In the LED lighting device of the present invention, some of the luminescent devices may be conducted before the rectified AC voltage reaches the overall turn-on voltage of all luminescent devices for improving the power factor. The current controllers may provide flexible current settings and switch-on/off voltages by setting the mode selection pins MS1 and MS2, so that the turn-on/off sequence, turn-on/off period and the brightness of each luminescent device may be easily selected. Therefore, the present invention may provide lighting devices having large effective operational voltage range, high brightness and flexible designs with various characteristics.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) lighting device, comprising:

a first luminescent device including:

a first end coupled to a rectified alternative-current (AC) voltage; and a second end;

a second luminescent device coupled in series to the first luminescent device;

a first current controller configured to operate according to a first current setting and a first switch voltage, and comprising:

a first pin coupled to the first end of the first luminescent device;

a second pin coupled to the second end of the first luminescent device; and a plurality of mode selection pins arranged to set the first current setting and/or the first switch voltage; and a second current controller configured to operate according to a second current setting and comprising:

a first pin coupled to the second luminescent device;

a second pin coupled to the rectified AC voltage; and a plurality of mode selection pins arranged to set the second current setting.

2. The LED lighting device of claim 1, wherein:

during a rising period or a falling period of the rectified AC voltage when a voltage established across the first current controller does not exceed a first voltage, the first luminescent device is turned off, and the first current controller is configured to conduct first current which varies with the rectified AC voltage;

during the rising period when the voltage established across the first current controller exceeds the first voltage but does not exceed the first switch voltage, the first luminescent device is turned off, and the first current controller is configured to maintain the first current at the first current setting; and during the rising period when the voltage established across the first current controller exceeds the first switch voltage, the first current controller is turned off, and the first luminescent device is turned on and configured to conduct second current.

3. The LED lighting device of claim 2, wherein during the falling period when the voltage established across the first current controller is between the first voltage and a second switch voltage larger than or equal to the first switch voltage, the first current controller is configured to conduct the first current and maintain the first current at the first current setting.

4. The LED lighting device of claim 3, wherein the first switch voltage and the second switch voltage are determined by logic levels of the plurality of mode selection pins in the first current controller.

5. The LED lighting device of claim 3, wherein the first current controller comprises:

a switch configured to operate according to a first control signal;

a voltage-detecting circuit configured to monitor the voltage established across the first current controller and output a corresponding second control signal; and a control circuit configured to generate the first control signal according to the second control signal, current flowing through the switch and logic levels of the plurality of mode selection pins in the first current controller.

6. The LED lighting device of claim 5, wherein the voltage-detecting circuit comprises:

an edge-detecting circuit configured to determine whether the rectified AC voltage is during the rising period or the falling period;

a first hysteresis comparator configured to determine a relationship between the first switch voltage and the voltage established across the first current controller;

a second hysteresis comparator configured to determine a relationship between the second switch voltage and the voltage established across the first current controller; and a logic circuit configured to generate the second control signal according to determining results of the edge-detecting circuit, the first hysteresis comparator and the second hysteresis comparator.

7. The LED lighting device of claim 5, wherein the control circuit comprises:

an adjustable reference voltage generator configured to provide multiple reference voltages and output one of the multiple reference voltages according logic levels of the plurality of mode selection pins;

a current-detecting circuit coupled in series to the switch and configured to provide a feedback voltage associated with the current flowing through the switch; and a comparator configured to provide the first control signal according to a relationship between the feedback voltage and the reference voltage outputted by the adjustable reference voltage generator.

8. The LED lighting device of claim 1, wherein:

during a rising period or a falling period of the rectified AC voltage when a voltage established across the second current controller does not exceed a second voltage, the second current controller is configured to conduct third current which varies with the rectified AC voltage; and during the rising period or the falling period when the voltage established across the second current controller exceeds the second voltage, the second current controller is configured to maintain the third current at the second current setting.

9. The LED lighting device of claim 1, wherein the first current controller and the first luminescent device are fabricated as a first integrated chip, and the second current controller and the second luminescent device are fabricated as a second integrated chip.

10. An LED lighting device, comprising:

a first luminescent device including:

a first end coupled to a rectified AC voltage; and a second end;

a second luminescent device including:

a first end coupled to the second end of the first luminescent device; and a second end;

a third luminescent device including:

a first end coupled to the second end of the second luminescent device; and a second end;

a fourth luminescent device including:

a first end coupled to the second end of the third luminescent device; and a second end;

a first current controller configured to conduct first current smaller than or equal to a first current setting, switch off according a first switch-off voltage during a rising period of the rectified AC voltage, and switch on according a first switch-on voltage during a falling period of the rectified AC voltage, the first current controller comprising:

a first pin coupled to the first end of the first luminescent device;

a second pin coupled to the second end of the first luminescent device; and a first mode selection pin and a second mode selection pin for setting the first current setting, the first switch-on voltage, and/or the first switch-off voltage;

a second current controller configured to conduct second current smaller than or equal to a second current setting, switch off according a second switch-off voltage during the rising period, and switch on according a second switch-on voltage during the falling period, the second current controller comprising:

a first pin coupled to the first end of the second luminescent device;

a second pin coupled to the second end of the second luminescent device; and a first mode selection pin and a second mode selection pin for setting the second current setting, the second switch-on voltage, and/or the second switch-off voltage;

a third current controller configured to conduct third current smaller than or equal to a third current setting, switch off according a third switch-off voltage during the rising period, and switch on according a third switch-on voltage during the falling period, the third current controller comprising:

a first pin coupled to the first end of the third luminescent device;

a second pin coupled to the second end of the third luminescent device; and a first mode selection pin and a second mode selection pin for setting the third current setting, the third switch-on voltage, and/or the third switch-off voltage; and a fourth current controller configured to conduct fourth current smaller than or equal to a fourth current setting and comprising:

a first pin coupled to the second end of the fourth luminescent device;

a second pin coupled to the rectified AC voltage; and a first mode selection pin and a second mode selection pin for setting the fourth current setting.

11. The LED lighting device of claim 10, wherein the first current controller and the first luminescent device are fabricated as a first integrated chip, the second current controller and the second luminescent device are fabricated as a second integrated chip, the third current controller and the third luminescent device are fabricated as a third integrated chip, and the fourth current controller and the fourth luminescent device are fabricated as a fourth integrated chip.

12. The LED lighting device of claim 11, wherein the first integrated chip is arranged in:

a first configuration in which the first mode selection pin of the first current controller is floating or is connected to the first pin of the first current controller and the second mode selection pin of the first current controller is connected to the second pin of the first current controller;

a second configuration in which the first mode selection pin of the first current controller is connected to the second pin of the first current controller and the second mode selection pin of the first current controller is floating or is connected to the first pin of the first current controller;

a third configuration in which the first mode selection pin and the second mode selection pin of the first current controller are floating or connected to the first pin of the first current controller; or a fourth configuration in which the first mode selection pin and the second mode selection pin of the first current controller are connected to the second pin of the first current controller.

13. The LED lighting device of claim 11, wherein:

the first integrated chip is arranged in a first configuration in which the first mode selection pin of the first current controller is floating or is connected to the first pin of the first current controller and the second mode selection pin of the first current controller is connected to the second pin of the first current controller;

the second integrated chip is arranged in a second configuration in which the first mode selection pin of the second current controller is connected to the second pin of the second current controller and the second mode selection pin of the second current controller is floating or is connected to the first pin of the second current controller;

the third integrated chip is arranged in a third configuration in which the first mode selection pin and the second mode selection pin of the third current controller are floating or connected to the first pin of the third current controller; and the fourth integrated chip is arranged in a fourth configuration in which the first mode selection pin and the second mode selection pin of the fourth current controller are connected to the second pin of the fourth current controller.

14. The LED lighting device of claim 10, wherein the fourth current setting is larger than any of the first to third current settings.

15. The LED lighting device of claim 10, wherein the fourth current controller is further configured to switch off when a voltage established across the first and the second pins of the fourth current controller exceeds a predetermined value.

* * * * *